US007206526B2

(12) United States Patent
Kobayashi

(10) Patent No.: US 7,206,526 B2
(45) Date of Patent: Apr. 17, 2007

(54) IMAGE FORMING APPARATUS AND METHOD FOR NOTIFYING THE TONER NEAR-EMPTY

(75) Inventor: Yasukazu Kobayashi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 64 days.

(21) Appl. No.: 11/076,392

(22) Filed: Mar. 9, 2005

(65) Prior Publication Data

US 2006/0204255 A1 Sep. 14, 2006

(51) Int. Cl.
*G03G 15/08* (2006.01)

(52) U.S. Cl. ..... 399/27

(58) Field of Classification Search ..... 399/24, 399/27, 53, 61

See application file for complete search history.

(56) References Cited

U.S. PATENT DOCUMENTS 5,655,174 A * 8/1997 Hirst ..... 399/27
6,052,547 A * 4/2000 Cuzzo et al. ..... 399/24 X
6,295,423 B1 * 9/2001 Haines et al. ..... 399/24
6,594,451 B2 * 7/2003 Kakeshita et al. ..... 399/24
6,820,039 B2 * 11/2004 Johnson et al. ..... 399/27 X
6,829,443 B2 * 12/2004 Byun et al. ..... 399/27 X

FOREIGN PATENT DOCUMENTS

JP 2001-239729 9/2001

* cited by examiner

*Primary Examiner*—Sandra L. Brase
(74) *Attorney, Agent, or Firm*—SoCal IP Law Group LLP; Steven C. Sereboff; John E. Gunther

(57) ABSTRACT

An image forming apparatus 1 comprises a toner cartridge, a display portion 33 for notifying a toner near-empty, storage portions 34, 37 for storing, as data, a toner amount housed in a new toner cartridge, a toner consumption amount when the toner cartridge is used and operating time of the image forming apparatus, and a control portion 31 for executing a program for notifying a toner near-empty. A toner supply predication point and a toner supply preparation point are calculated from a toner amount housed in a new toner cartridge, a toner consumption amount when the toner cartridge is used and operating time of the image forming apparatus, and when reaching the toner supply preparation point, the toner near-empty is displayed to notify it.

8 Claims, 4 Drawing Sheets

IMAGE FORMING APPARATUS AND METHOD FOR NOTIFYING THE TONER NEAR-EMPTY

BACKGROUND OF THE INVENTION

1. Field of the Invention

The present invention relates to an image forming apparatus employing an electronic photographic system such as a laser printer, an electronic photographic copier and the like, and a method for notifying toner near-empty.

2. Related Art Statement

In an image forming apparatus 51 employing an electronic photographic system such as a laser printer, an electronic photographic copier and the like, as shown in FIG. 1, first, the photosensitive drum 52 surface is charged to a fixed surface potential by a charge device 53, and subsequently, the photosensitive drum 52 surface is exposed by an exposure device 54 such as a semiconductor laser to attenuate the surface potential to form an electrostatic latent image. And a bias voltage is applied to a developer roller 56 surface of a developer device 55, a toner charged within the developer device 55 is adhered to an electrostatic latent image forming portion of the photosensitive drum 52 surface, the electrostatic latent image forming portion is developed and actualized to form a toner image on the photosensitive drum 52 surface.

On the other hand, a sheet of paper P is caffied to a transfer region by carrier rollers 57, the sheet P is charged by a transfer device 58, and the toner image formed on the photosensitive drum 52 surface is transfeffed to the sheet. Subsequently, the sheet P is peeled off from the photosensitive drum 52 surface by a peel-off device 59, and the toner image is fixed to the sheet P surface by a fixing device (not shown), after which the sheet P is drawn off outside the apparatus by draw-off rollers (not shown).

After the toner image has been transferred to the sheet P surface, the toner remained on the photosensitive drum 52 surface is scraped away and withdrawn by a blade 61 of a cleaning device 60, and subsequently, electric charge remained on the photosensitive drum 52 surface is removed by an electric remover 62 to place the photosensitive drum 52 surface in an initial state.

For example, in the developer device 55 employing a 2-component developing system, a developer D comprising a caffier C as magnetic powder and a toner T as colored resin powder is housed in the developing device, and the caffier C and the toner T are mixed and stirred by stirring screws 63 and 64 so as to charge toner by friction. Where toner T is consumed by development, toner T is supplied into the developing device 55 from a toner cartridge (not shown) disposed upward, and similarly to the above, the supplied toner T and the carrier C are mixed, stirred and charged.

Normally, a toner remaining amount sensor is disposed within the toner cartridge so that the toner remaining amount within the toner cartridge is detected continuously, and where the toner remaining amount is less than a fixed value, a toner near-empty is notified. Further, without providing the toner remaining amount sensor, where image signals forming dots of a print image are counted and the total value thereof is over a fixed value, a toner near-empty is notified.

However, in any of image forming apparatus described above, the toner consumption amount is varied greatly due to the actual using environment such as temperature and humidity of using places, a print image pattern, a sheet consumption amount per hour, and the like, and therefore, there is a problem that the toner near-empty cannot be notified accurately.

For overcoming the above-described problem, there is proposed an image forming apparatus wherein a dot number addition value of a print image in a toner cartridge prior to exchange is amended into a toner near-empty prediction value in a toner cartridge after exchange, and when a dot number addition value of a print image in a toner cartridge after exchange reaches a toner near-empty prediction value, a toner near-empty is notified (Japanese Patent Laid-Open No. 239729/2001 Publication).

However, toner housed in a toner cartridge is normally not consumed in a short period such as two or three weeks, but consumed over a long period such as two or three weeks or more, and therefore, the using circumstances in the toner cartridge prior to exchange and the toner cartridge after exchange are sometimes changed remarkably. Therefore, there is a problem that even if a dot number addition value in a toner cartridge prior to exchange is amended, accuracy is low by only such an amendment for use as a toner near-empty prediction value in a toner cartridge after exchange.

Further, the using frequency of the image forming apparatus greatly changes depending upon month, week, day of the week, time zone of day, and the like, and the toner consumption amount per hour greatly varies accordingly. Furthermore, time required till a toner cartridge is actually exchanged after toner near-empty has been notified is greatly different between where a service man exchanges it and where a user or a manager exchanges it. However, in the above-described image forming apparatus, nothing has been taken into consideration for such a point.

SUMMARY OF THE INVENTION

The present invention has been accomplished to overcome the problem in the conventional image forming apparatus, and has its object to provide an image forming apparatus capable of notifying a higher accurate toner near-empty adapted to the using circumstances of the image forming apparatus.

It is a further object of the invention to provide an image forming apparatus capable of efficiently exchanging a toner cartridge without notifying a toner near-empty for a uselessly long period of time in consideration of time required till a cartridge is exchanged.

For achieving the above-described objects, an image forming apparatus according to the present invention comprises an exchangeable toner cartridge; a display portion for notifying a toner near-empty; a storage portion for storing, as data, a toner amount housed in a new toner cartridge, a toner consumption amount when a toner cartridge is used and operating time of an image forming apparatus; and a control portion for executing a program for notifying a toner near-empty, wherein a toner supply prediction point and a toner supply preparation point are calculated from a toner amount housed in a new toner cartridge, a toner consumption amount when a toner cartridge is used and operating time of an image forming apparatus in the control portion, and when reaching the toner supply preparation point, a toner near-empty is displayed on the display portion and notified.

Further, a method for notifying a toner near-empty in an image forming apparatus according to the present invention is characterized in that a toner supply prediction point and a toner supply preparation point are calculated from a toner amount housed in a new toner cartridge, a toner consumption amount when a toner cartridge is used and operating time of an image forming apparatus, and when reaching the toner supply preparation point, a toner near-empty is notified.

DETAILED DESCRIPTION OF THE INVENTION

The embodiments of the image forming apparatus according to the present invention will be described in detail with reference to the drawings.

Figure 1:
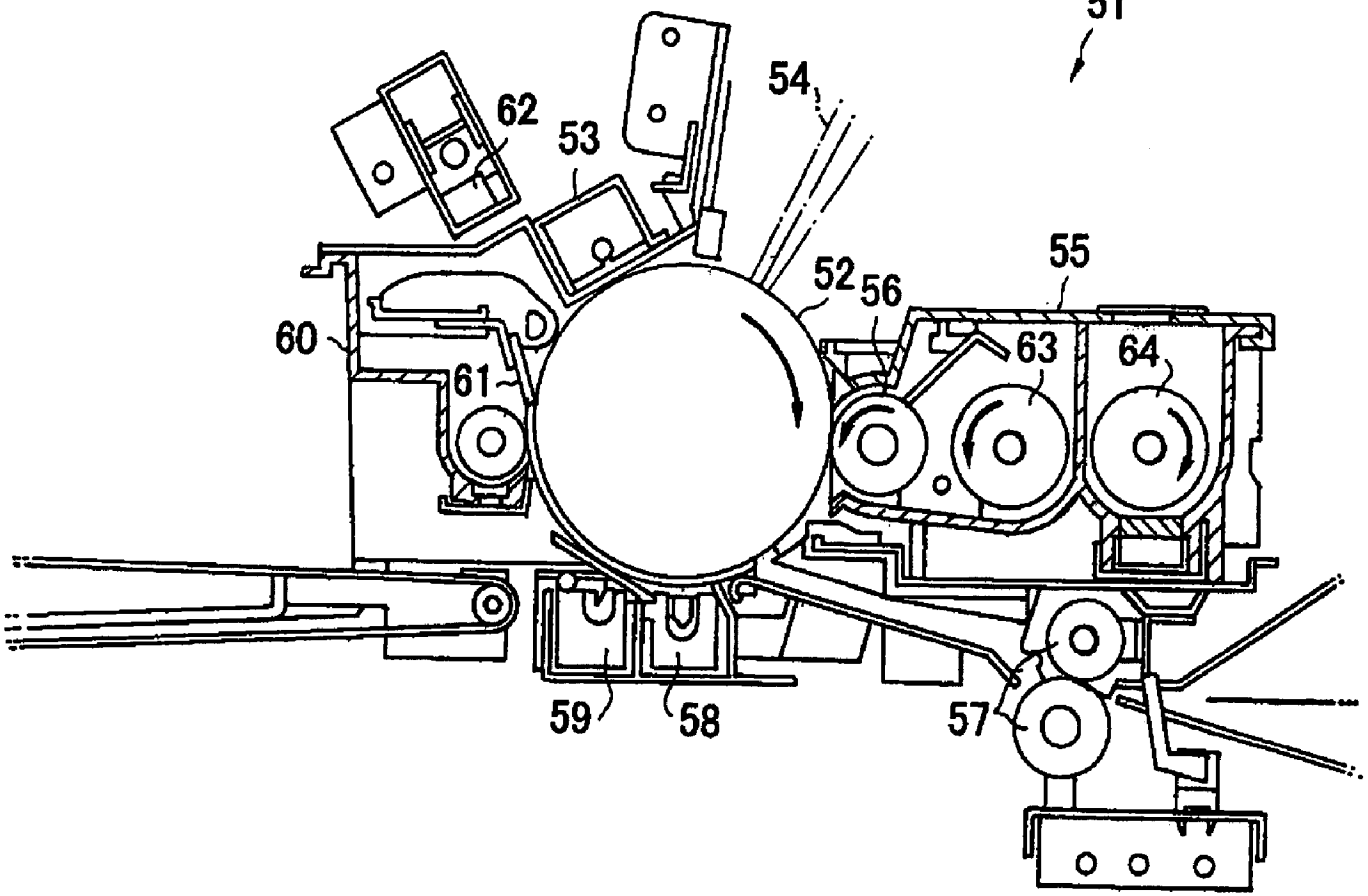
FIG. 1 is a schematic sectional view of an image forming apparatus.

The schematic structure of the image forming apparatus 1 according to the present invention is similar to the conventional image forming apparatus as shown in FIG. 1.

Figure 2:
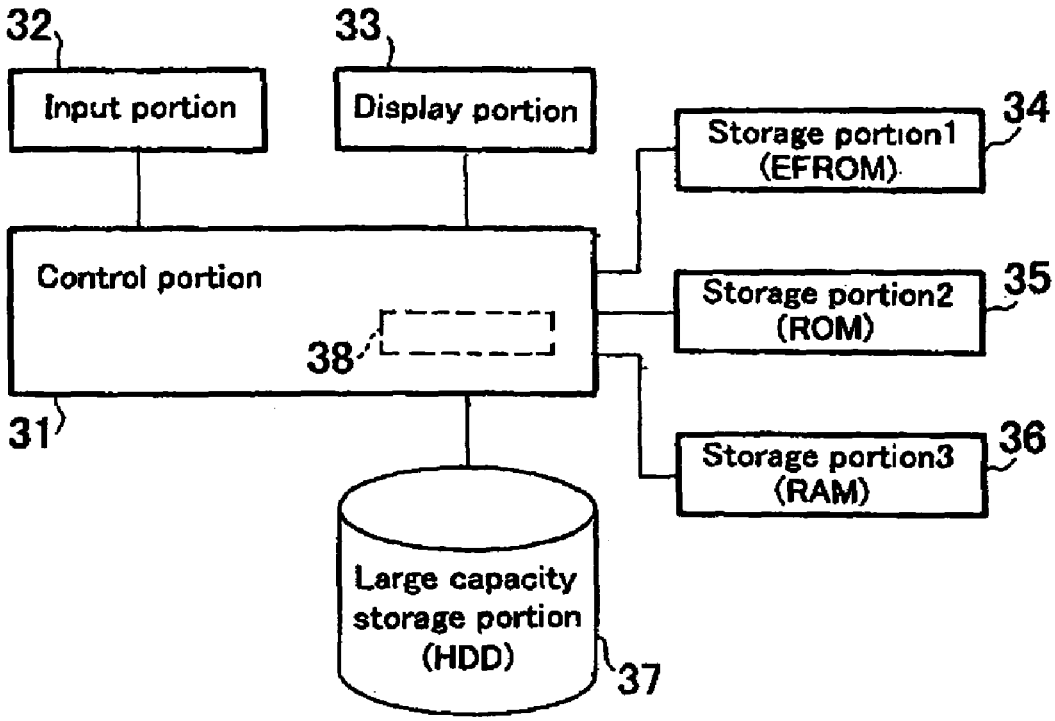
FIG. 2 is a control structural view of the image forming apparatus according to the present invention.

The control structure of the image forming apparatus 1 according to the present invention comprises a control portion 31; an input portion 32; a display portion 33; a first storage portion 34; a second storage portion 35; a third storage portion 36; a large capacity storage portion 37 and the like, as shown in FIG. 2.

The control portion 31 has a CPU (Central Processing Unit) and executes almost all control operations such as a print operation of the image forming apparatus 1. And the CPU (Central Processing Unit) is provided with a clock generator 38.

The input portion 32 comprises various buttons and keys disposed on an operating panel of the image forming apparatus 1, and the display portion 33 comprises a liquid crystal panel disposed on the operating panel.

The first storage portion 34 comprises a writable EEPROM and the like to store in advance various set values such as the dot number of print images when toner housed in a toner cartridge is completely consumed, time required to supply toner, and the like.

The second storage portion 35 comprises an unwritable ROM and the like to store a program for notifying a toner near-empty and the like.

The third storage portion 36 comprises a read/writable RAM and the like to store various data that should be preserved temporarily during operation of the image forming apparatus 1, and the like.

The large capacity storage portion 37 comprises a read/writable HDD and like to store various data of a dot number addition value of print images in a toner cartridge calculated by executing a program for notifying a toner near-empty, operating time of the image forming apparatus, remaining operatable time calculated thereby and the like.

Next, a description of a method for notifying a toner near-empty by executing a program for notifying a toner near-empty in the image forming apparatus 1 according to the present invention will be made.

Figure 3:
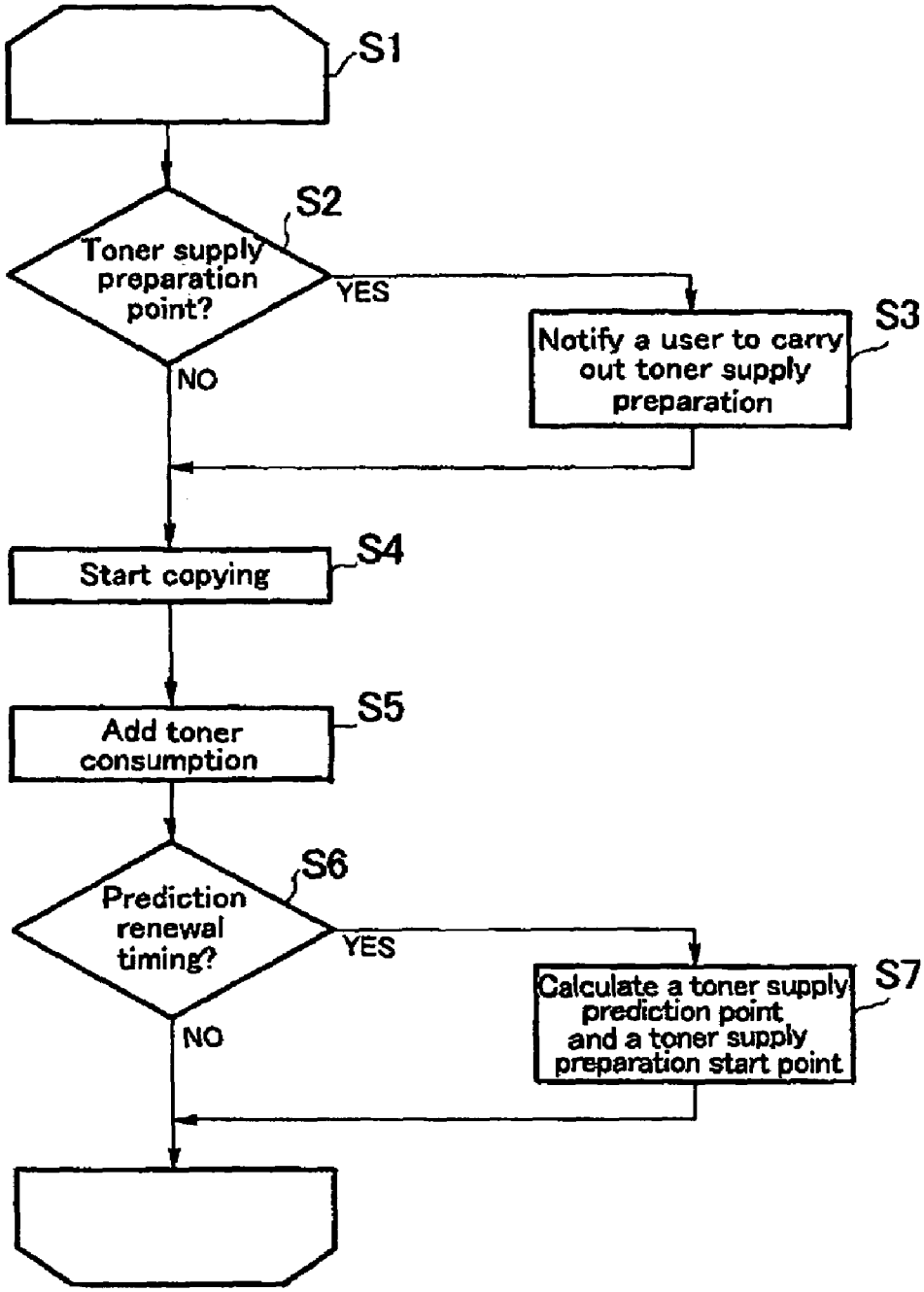
FIG. 3 is a flowchart of a program for notifying a toner near-empty.

As shown in FIG. 3, when a power source of the image forming apparatus 1 is turned on (Step 1), first, judgment is made whether the toner cartridge is at the toner supply preparation point, that is, whether it is in the toner near-empty state (Step 2). Where it is at the toner supply preparation point, the toner near-empty state is displayed on the liquid crystal panel, i.e. the display portion 33 (Step 3).

When the copying operation starts (Step 4), the toner consumption amount in the toner cartridge is calculated (Step 5).

Here, where the image forming apparatus 1 is a digital device comprising an image scanner, a laser printer, a liquid crystal printer and the like, the dot number of the print image can be calculated to calculate the toner consumption amount.

Figure 4:
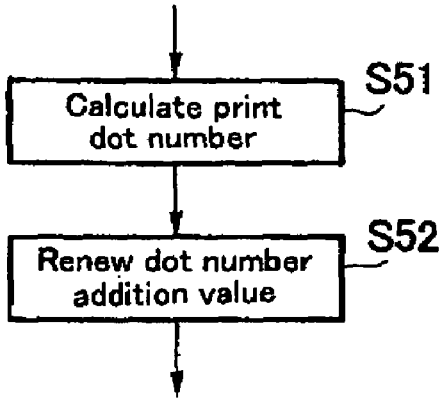
FIG. 4 is a flowchart showing one example of a routine for calculating a toner consumption amount.

In this case, as shown in FIG. 4, after the dot number of the print image has been calculated every time the copying operation for one sheet is executed (Step 51), the dot number is added to renew the dot number addition value of the print image (Step 52).

After the toner consumption amount in the toner cartridge has been calculated, judgment is made whether it is in timing for renewing the toner supply prediction point (Step 6). This timing is a suitable period, for example, every 30 minutes. Where it is timing for renewing the tone supply prediction point, calculation relating to the toner supply predication point and the toner supply preparation point is executed (Step 7).

The toner supply predication point termed herein is time at which toner housed in the toner cartridge is approximately consumed, and the toner supply preparation point termed herein is time at which toner housed in the toner cartridge becomes reduced, and the toner supply should be prepared, which is time for notifying toner near-empty. These toner supply predication point and toner supply preparation point can be calculated, for example, by the dot number addition value of the print image and the operating time of the image forming apparatus.

Figure 5:
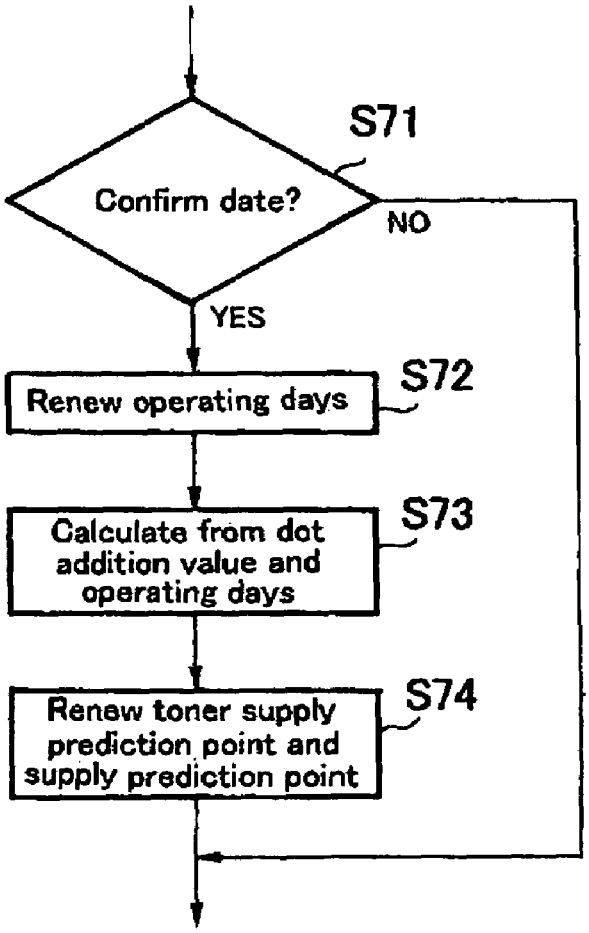
FIG. 5 is a flowchart showing one example of a routine for calculating a toner supply predication point and a toner supply preparation point.

In this case, as shown in FIG. 5, first, judgment is made whether date is confirmed in order to calculate the toner supply preparation point (Step 71), and where date is confirmed, the operating time of the image forming apparatus is renewed (Step 72). And, the toner supply predication point and the toner supply preparation point are calculated from the dot number addition value of the print image and the operating time of the image forming apparatus (Step 73). It is noted that the operating time of the image forming apparatus may be applied not only the operating time literally but also the operating days.

For example, let DT be the dot number of the print image where toner is completely consumed, and DA be the dot number addition value of the print image, the dot number DB of the print image corresponding to the remaining toner is expressed by $$DB=DT-DA \tag{1}$$

On the other hand, let PA be the operating time (days) of the image forming apparatus, the dot number $\Delta D$ of the print image corresponding to the toner consumed per time (one day) is expressed by $$\Delta D=DA/PA \tag{2}$$

and the toner supply predication point XO is calculated by $$XO=DB/\Delta D \tag{3}$$

Here, if time (days) required for toner supply is set to PT, the toner supply preparation point XA is calculated by $$XA=XO-PT \quad (4)$$

In his manner, after the toner supply prediction point XO and the toner supply preparation point XA have been calculated, they are substituted for the prior ones to renew (Step 74).

Then, judgment is made whether the toner cartridge is at the renewed toner supply preparation point XA, that is, it is in the toner near-empty state (Step 2). Where it is at the toner supply preparation point XA, the toner near-empty state is displayed on the liquid crystal panel, i.e. the display portion 53 (Step 3).

As described above, if the toner supply prediction point and the toner supply preparation point are calculated by the toner consumption amount and the operating time (days), the higher accurate toner near-empty taken into consideration of the using circumstances of the image forming apparatus can be notified.

Further, if time required till the toner cartridge is replaced is set in advance, for the uselessly long period of time toner near-empty need not be notified, and the toner cartridge can be replaced efficiently.

Preferably, the toner consumption amount in the toner cartridge is divided every month, week, day of the week, and time zone and totaled. If doing so, the month, week, day of the week, and time zone are incorporated to enable notifying the higher accurate toner near-empty.

Further, not only the toner near-empty state is displayed on the liquid crystal panel, i.e. the display portion 53, but also an electronic mail may be transmitted to a specific user to inform the toner near-empty state thereto.

What is claimed is:

1. An image forming apparatus comprising:

an exchangeable toner cartridge;

a display portion for notifying a toner near-empty;

a storage portion for storing, as data, a toner amount housed in a new toner cartridge, a toner consumption amount when a toner cartridge is used and operating time of an image forming apparatus; and a control portion for executing a program for notifying a toner near-empty, wherein a toner supply prediction point and a toner supply preparation point are calculated and renewed at fixed time intervals from a toner amount housed in a new toner cartridge, a toner consumption amount when a toner cartridge is used and operating time of an image forming apparatus in the control portion, and when reaching the toner supply preparation point, a toner near-empty is displayed on the display portion to notify it.

2. The image forming apparatus according to claim 1, wherein an input portion for setting time required to supply toner is disposed;

a toner supply prediction point and a toner supply preparation point are calculated and renewed at fixed time intervals in the control portion in consideration of time required for a toner supply, and when reaching the toner supply preparation point, the toner near-empty is displayed on the display portion to notify it.

3. The image forming apparatus according to claim 1, wherein the toner consumption amount is calculated by the dot number of the print image.

4. The image forming apparatus according to claim 1, wherein said display portion is a liquid crystal panel.

5. A method for notifying a toner near-empty in an image forming apparatus, said method being characterized in that a toner supply prediction point and a toner supply preparation point are calculated and renewed at fixed time intervals from a toner amount housed in a new toner cartridge, a toner consumption amount when a toner cartridge is used and operating time of an image forming apparatus in the control portion, and when reaching the toner supply preparation point, a toner near-empty is displayed on the display portion to notify it.

6. A method for notifying a toner near-empty in an image forming apparatus according to claim 5, said method being characterized in that a toner supply prediction point and a toner supply preparation point are calculated and renewed at fixed time intervals in consideration of time required for a toner supply, and when reaching the toner supply preparation point, the toner near-empty is notified.

7. The method for notifying a toner near-empty in an image forming apparatus according to claim 5, wherein the toner consumption amount is calculated by the dot number of the print image.

8. The method for notifying a toner near-empty in an image forming apparatus according to claim 5, wherein the toner consumption amount is calculated every execution of print operation.

* * * * *

UNITED STATES PATENT AND TRADEMARK OFFICE

CERTIFICATE OF CORRECTION

PATENT NO. : 7,206,526 B2
APPLICATION NO. : 11/076392
DATED : April 17, 2007
INVENTOR(S) : Kobayashi It is certified that error appears in the above-identified patent and that said Letters Patent is hereby corrected as shown below:

Column 1 line 29, replace “caffied” with --carried--.

Column 1 line 32, replace “transfeffed” with --transferred--.

Column 1 line 48, replace “caffier” with --carrier--.

Column 1 line 48, replace “caffier” with --carrier--.

Signed and Sealed this

Nineteenth Day of June, 2007

JON W. DUDAS
*Director of the United States Patent and Trademark Office*